United States Patent [19]

Foreman

[11] Patent Number: 4,647,318

[45] Date of Patent: Mar. 3, 1987

[54] SOLUTION HEAT TREATMENT FOR ALUMINUM ALLOYS

[76] Inventor: Robert W. Foreman, 4343 Covered Bridge, Bloomfield Hills, Mich. 48013

[21] Appl. No.: 783,611

[22] Filed: Oct. 3, 1985

[51] Int. Cl.[4] ..... C22F 1/04

[52] U.S. Cl. ..... 148/20; 148/27

[58] Field of Search ..... 148/20, 20.6, 27, 28

[56] References Cited

U.S. PATENT DOCUMENTS 2,416,378 2/1947 Chandler et al. ..... 148/20

*Primary Examiner*—R. O. Dean

*Attorney, Agent, or Firm*—Krass & Young

[57] ABSTRACT

A method of solution heat treating aluminum alloys, especially aluminum-lithium alloys, by immersing the alloy article in a chloride based neutral salt bath rather than in the conventionally used nitrate based salt bath. A chloride based bath, at least in certain controlled situations, produces an effective solution heat treatment but without the staining and corrosive reaction often encountered with the nitrate based salt baths. A chloride based salt comprising 55% potassium chloride, 40% lithium chloride, and 5% sodium chloride is found to be particularly effective.

9 Claims, No Drawings

SOLUTION HEAT TREATMENT FOR ALUMINUM ALLOYS

TECHNICAL FIELD

This invention relates to aluminum alloys and more particularly to a novel method of solution heat treating aluminum alloys.

The intrinsic properties of aluminum make it one of the most versatile engineering and construction materials available. The aluminum industry offers hundreds of combinations of alloys and tempers, from which engineers and designers may select the most suitable metal for their needs. Pure aluminum however is soft and ductile and has limited commercial applicability. Most commercial uses require greater strength than pure aluminum affords. Higher strength is achieved by alloying other metal elements with aluminum and through processing and thermal treatments. The alloys can be classified into two categories, non-heat treatable and heat treatable. This invention concerns the heat treatable alloys.

The heat treatable alloys typically embody the alloying elements copper, magnesium, zinc and silicon. Since these elements singly or in combination show increasing solid solubility in aluminum with increasing temperature, it is possible to subject them to thermal treatments which will impart pronounced strengthening. The first treatment, called heat treatment or solution heat treatment, is an elevated temperature process designed to put the soluble element or elements in solid solution. This step is followed by a rapid quenching which momentarily freezes the structure and for a short time renders the alloy very workable. The alloys are not stable after quenching, and precipitation of the constituent from the supersaturated solid solution begins. The precipitation may constitute a natural aging process at room temperature or an artificial aging process at controlled elevated temperatures.

The solution heat treating step is performed at a high temperature, for example between 875° and 980° F., and operates to dissolve the alloy constituents which are later responsible for hardening of the alloy. The solution heat treatment of the alloyed articles is most typically carried out by immersing the articles in a nitrate salt bath. The nitrate salts most typically used to formulate the bath are $Na\ NO_3$, $K\ N\ O_3$. These nitrate salt baths provide an effective solution heat treating of the aluminum alloy articles but can react corrosively with the aluminum alloy articles at these elevated temperatures to damage and/or stain the surface of the article. Nitrate salt baths also present maintenance problems and can generate ecological problems.

BRIEF SUMMARY OF THE INVENTION

This invention is directed to the provision of an improved solution heat treating method for aluminum alloys.

According to the invention, the aluminum alloy is solution heat treated by immersing it in a bath of a chloride based neutral salt. The chloride based salt preferably has a melting point below 1000° F. and is preferably chosen from the group consisting of Li Cl, NaCl, K Cl, Ca $Cl_2$ and Ba $Cl_2$. The chloride based neutral salt bath is preferably heated to a temperature of at least 900° F. and the solution heat treating step is followed, as is typical, by a quenching step. The quenching may be performed by air cooling, water cooling, or water and polymer cooling.

The invention is applicable to all aluminum alloys but is especially effective in the solution heat treatment of aluminum-lithium alloys.

Chloride salts containing potassium chloride and lithium chloride have been found to be particularly effective. Specifically, a solution heat treatment of an aluminum-lithium alloy with a salt bath prepared from a salt having a composition of approximately 55% potassium chloride, 40% lithium chloride and 5% sodium chloride produced no damage or stain on the surface of the aluminum-lithium alloy article.

DESCRIPTION OF THE INVENTION

In accordance with the invention, an aluminum alloy article is solution heat treated by immersing the article in a bath of a chloride based neutral salt. The invention treatment has been found to be especially effective when applied to aluminum lithium alloys but has applicablity to a wide range of aluminum alloys.

The chloride based salts used in formulating the bath are preferably formulated from alkali and alkaline earth chlorides such as lithium chloride, sodium chloride, potassium chloride, calcium chloride or barium chloride. The chloride based salt used in the invention preferably melts below 1000° F. and as low as 700° F. It has been found that the salts can be used to solution heat treat aluminum alloys without reacting with the aluminum alloy article, especially if moisture and heavy metal such as iron, nickel and chromium are carefully excluded from the bath. Solution treating temperatures with some of the more reactive aluminum alloys such as aluminum-lithium and aluminum-magnesium can be above 900° F. and some even about 1000° F. Conventionally used nitrate based salts in this temperature range can be dangerously reactive to the alloy article and can result in serious corrosive or staining action. The chloride salts, by contrast, are just as effective as the nitrate based salts in performing the solution heat treating operation and, in general, are less reactive with the alloy and accordingly produce less staining or corrosive action on the alloyed article. The chloride baths are also easier to maintain and present fewer ecological problems.

EXAMPLES

Four aluminum-lithium alloy test specimens were used in the testing procedures. The alloys were:

Alloy Test Specimen 1—2.5% Li

Alloy Test Specimen 2—2.5% Li, 4.0% Mg

Alloy Test Specimen 3—2.5% Li, 0.5% Mg, 1.0% Cu

Alloy Test Specimen 4—3.5% Li

Four different salts were used in the test procedures. The salts were:

Salt 1—A110699 Class II (60% sodium nitrate and 40% potassium nitrate)

Salt 2—700 Salt Damp (55% potassium chloride, 40% lithium chloride, and 5% sodium chloride)

Salt 3—800 Salt Damp (50% calcium chloride, 30% barium chloride and 20% sodium chloride)

Salt 4—100% $NaNO_3$

Each of the above salts is available, under the above specified designation, from Park Chemical Company of Detroit, Mich.

The following procedures were followed with respect to all tests:

1. The salt was melted in a small crucible and held at 1000° F., except that in test No. 26, the salt (NaNO3) was held at 1050° F.
2. Samples of the aluminum-lithium alloy were first polished and then weighed and then held in the crucible in the melted salt for 15 minutes to avoid any contact with metal.
3. The alloy samples were then quenched in 150° F. water, washed, dryed, reweighed and the surface examined for possible attack.
4. The 700 Salt Damp and the 800 Salt Damp were run both before and after dehydration by aluminum sheeting.
5. The A110699B Class 2 and the $NaNO_3$ salts were run as received from production with no dehydration.
6. An Aluminum 6061 test specimen was also run in the A110699B bath (Test No. 27) for comparison purposes.

In the following table summarizing the results of the test, the following color/corrosion ratings are employed:

A—no attack or stain
B—a slight general stain
C—definite surface stain
D—dark spotty stain and slight etching
E—dark overall stain and etching

TABLE

| Test No. | Salt | Salt Pre-treatment | Alloy Test Specimen | Weight Loss (Mg.) | Color/ Corrosion |
|---|---|---|---|---|---|
| 1 | 1 | None | 1 | 1.0 | A/B |
| 2 | 1 | None | 1 | 2.0 | B/C |
| 3 | 1 | None | 1 | 1.0 | A |
| 4 | 1 | None | 2 | 1.0 | B |
| 5 | 1 | None | 2 | 0.0 | A/B |
| 6 | 1 | None | 3 | 1.0 | C |
| 7 | 1 | None | 4 | 7.0 | A |
| 8 | 1 | None | 4 | 1.0 | A/B |
| 9 | 2 | None | 1 | 1.0 | A |
| 10 | 2 | None | 2 | 1.0 | C |
| 11 | 2 | None | 3 | 1.0 | B |
| 12 | 2 | None | 4 | 0.0 | A |
| 13 | 2 | Sheeted Dry | 1 | 1.0 | A |
| 14 | 2 | Sheeted Dry | 2 | 0.0 | A |
| 15 | 2 | Sheeted Dry | 3 | 1.0 | A |
| 16 | 2 | Sheeted Dry | 4 | 1.0 | A |
| 17 | 3 | None | 1 | 0.0 | D |
| 18 | 3 | None | 2 | 1.0 | D |
| 19 | 3 | None | 3 | 2.0 | E |
| 20 | 3 | None | 4 | 1.0 | E |
| 21 | 3 | Sheeted Dry | 1 | 1.0 | B |
| 22 | 3 | Sheeted Dry | 2 | 1.0 | D |
| 23 | 3 | Sheeted Dry | 3 | 2.0 | C/D |
| 24 | 3 | Sheeted Dry | 4 | 1.0 | B |
| 25 | 4 | None | 3 | 1.0 | C |
| 26 | 4 | None | 3 | 1.0 | B/C |

TABLE-continued

| Test No. | Salt | Salt Pre-treatment | Alloy Test Specimen | Weight Loss (Mg.) | Color/ Corrosion |
|---|---|---|---|---|---|
| 27 | 1 | None | Aluminum 6061 | 0.0 | B |

SUMMARY

As seen from the above table, of all the tests run with the noted salts, the best results were obtained with 700 Salt Damp dehydrated. The poorest results were with 800 Salt Damp used without dehydration. The dehydration improved inertness for both the 700 Salt Damp and 800 Salt Damp but the dehydrated 800 Salt Damp was still less satisfactory than the undehydrated 700 Salt Damp.

The test results establish that a chloride based neutral salt, and especially a chloride based neutral salt having a heavy potassium chloride concentration of for example 55%, a heavy lithium chloride concentration of for example 40%, and a light sodium chloride concentration of four example 5%, produce no attack or stain when used as the heat treating salt in the solution heat treatment of a wide variety of aluminium-lithium alloys.

I claim:

1. The process of solution heat treating an aluminum alloy article by immersing the article in a bath which is formed of a chloride based neutral salt chosen from the group consisting of Li Cl, Na Cl, K Cl, Ca $Cl_2$ and Ba $Cl_2$ and which is heated to a temperature of at least 875° F.

2. The process of claim 1 wherein said chloride based salt has a melting point below 1000° F.

3. The process of claim 1 wherein said salt comprises a mixture of two or more salts from said group.

4. The process of claim 1 wherein said bath is heated to a temperature of at least 900° F.

5. The process of claim 1 wherein, following the solution heat treating in the chloride based salt, the article is quenched by air cooling, or water cooling, or water plus polymer cooling.

6. The process of claim 1 wherein said article is formed of a aluminum-lithium alloy.

7. The process of solution heat treating an aluminum alloy article by immersing the article in a bath which is formed of a chloride based neutral salt including potassium chloride and lithium chloride and which is heated to a temperature of at least 875° F.

8. The process of claim 7 wherein said salt further includes sodium chloride.

9. The process of claim 8 wherein said salt has a composition of approximately 55% potassium chloride, 40% lithium chloride, and 5% sodium chloride.

* * * * *